US005672368A

United States Patent [19]

Perkins

[11] Patent Number: 5,672,368

[45] Date of Patent: Sep. 30, 1997

[54] BEVERAGE BAG AND METHOD OF USE

[76] Inventor: Warren E. Perkins, 3700 NE. Sugarhill Ave., Jensen Beach, Fla. 34957-3727

[21] Appl. No.: 688,949

[22] Filed: Jul. 31, 1996

[51] Int. Cl.[6] ..... B65B 29/04

[52] U.S. Cl. ..... 426/83; 426/433; 426/435; 426/77

[58] Field of Search ..... 426/77, 83, 78–82, 426/84, 112, 110, 433, 435

[56] References Cited

U.S. PATENT DOCUMENTS

| | | | |
|---|---|---|---|
| 1,493,981 | 5/1924 | Hirschhorn | 426/81 |
| 1,555,515 | 9/1925 | Peal | 426/77 |
| 2,149,713 | 3/1939 | Webber | 426/83 |
| 2,162,272 | 6/1939 | Patterson | 426/77 |
| 2,298,420 | 10/1942 | Salfisberg | 426/83 |
| 2,328,017 | 8/1943 | Irmscher | 426/81 |
| 2,328,018 | 8/1943 | Irmscher | 426/81 |
| 2,330,884 | 10/1943 | Harriman | 426/78 |
| 2,406,018 | 8/1946 | Irmscher | 426/83 |
| 2,468,464 | 4/1949 | Salfisberg | 426/83 |
| 3,384,492 | 5/1968 | Spencer | 426/83 |
| 3,415,656 | 12/1968 | Lundgren | 426/80 |
| 3,597,222 | 8/1971 | Kalemba | 426/83 |
| 3,767,420 | 10/1973 | Kim | 426/77 |
| 4,551,336 | 11/1985 | Chen | 426/77 |
| 4,801,464 | 1/1989 | Hubbard | 426/79 |
| 5,552,164 | 9/1996 | Kuipers et al. | 426/77 |
| 5,552,165 | 9/1996 | Haak et al. | 426/77 |

FOREIGN PATENT DOCUMENTS

| | | | |
|---|---|---|---|
| 58-149642 | 9/1983 | Japan | 426/78 |
| 1-99975 | 4/1989 | Japan | 426/77 |
| 258016 | 11/1948 | Switzerland | 426/77 |

*Primary Examiner*—Steven Weinstein
*Attorney, Agent, or Firm*—Roland H. Shubert

[57] ABSTRACT

A beverage bag containing a substance from which essences can be extracted by steeping is arranged so that steeping liquid does not drip from the bag during its transport from the steeping liquid to a place of disposal. The beverage bag is arranged as a generally planar envelope having at least one substantially straight side and an apex formed by the intersection of two envelope sides. A first handle, suitably string, is attached to the bag at a location that will cause the bag to hang with the apex at the lowermost point, thus facilitating rapid drainage of the steeping liquid from the bag contents. A second handle is attached to the bag at a location that will cause the bag to hang with its substantially straight side in a generally horizontal plane. Residual steeping liquid will be reabsorbed by the bag contents and the bag will then not drip during its transport to another location.

17 Claims, 3 Drawing Sheets

BEVERAGE BAG AND METHOD OF USE

TECHNICAL FIELD

This invention relates generally to improvements in beverage bags such as those used for the brewing of tea, coffee, herbs and the like, and to methods for using these improved bags.

More specifically, this invention relates to a beverage bag that is arranged so that residual liquid left in the bag after steeping is speedily drained therefrom, thus allowing the used bag to be transported for disposal without dripping.

BACKGROUND ART

Tea, coffee and herbal compositions are often packaged in small, porous bags sized such that the contents of a bag are sufficient to brew a single serving of the extract. The bag is constructed of a paper-like fabric that retains strength when wet, and is typically formed as a rectangular envelope which is folded over at the top and closed by a staple. The staple serves as well to attach a string handle to the bag to allow convenient removal of the bag from a liquid, usually hot water, in which it is steeped.

In brewing tea, for example, a tea bag is immersed in hot water that is held in a cup or other vessel, and is steeped to extract the essences from tea leaves contained in the bag. After brewing has been completed, the bag is withdrawn from the water and is transported to a receptacle for disposal. When the used tea bag is lifted from the water by means of its string handle, the bag hangs such that its bottom is generally horizontal. Residual liquid within the bag drains down and drips off along the length of the horizontal bottom.

The bag will ordinarily continue to drip for some time after its removal from the water. Some users will simply wait until the bag stops dripping. Others, less patient, will resort to a number of techniques to speed the disposal of the used bag. For example, some users will press the wet bag against the top inner surface of the cup with a spoon or other implement to squeeze out residual liquid. Some will place a spoon under the wet bag for transport, thus catching drips in the spoon. Yet others hold the wet bag above the tea cup and press it with tongs to remove the residual liquid.

This annoying problem has so far defied practical solution. It is evident that a functional technique to speed removal of liquid that remains in a beverage bag after steeping to avoid dripping of liquid from the bag as it is transported from a brewing vessel to a place of disposal would be found worthwhile by tea drinkers and other users of beverage bags. This invention provides a practical resolution to that problem.

SUMMARY OF THE INVENTION

This invention comprises a beverage bag arranged so that residual liquid that remains in the bag after steeping the bag and its contents is quickly drained therefrom, leaving the bag in a drip-free condition for transport and disposal. The bag comprises a generally planer envelope having either a single compartment or two or more generally parallel planar compartments as in the "flow-thru" kind. The bag is shaped to provide each compartment with at least one substantially straight side and an apex formed by the intersection of two envelope sides, the apex angle that is included between the two envelope sides being less than 140°. A first flexible handle, suitably string, is attached to the bag at a location whereat the apex angle is at the bottom when the bag is suspended by its handle. Another flexible handle, preferably the free end of the first, is attached to the bag at a second location whereat the straight side of the bag is oriented in a substantially horizontal attitude when the bag is suspended by the second handle. Most of the liquid remaining in the bag contents quickly drains from the bag and drips from the apex when the bag is held by the first handle. Holding the bag by its second handle then returns the bag to an attitude in which the straight bottom side of the bag is horizontal. Any residual liquid is redistributed back into the bag contents, and no further dripping occurs.

Hence, it is an object of this invention to provide an improved beverage bag together with methods for its use.

It is a specific object of this invention to provide a beverage bag that is arranged to minimize dripping of residual liquid when the used bag is removed for disposal after the essences of the bag contents are steeped therefrom.

It is yet another object of this invention to provide a method for removing a beverage bag from a steeping liquid in a manner that minimizes dripping of liquid remaining in the contents of the bag.

DESCRIPTION OF PREFERRED EMBODIMENTS OF THE INVENTION

Figure 1:
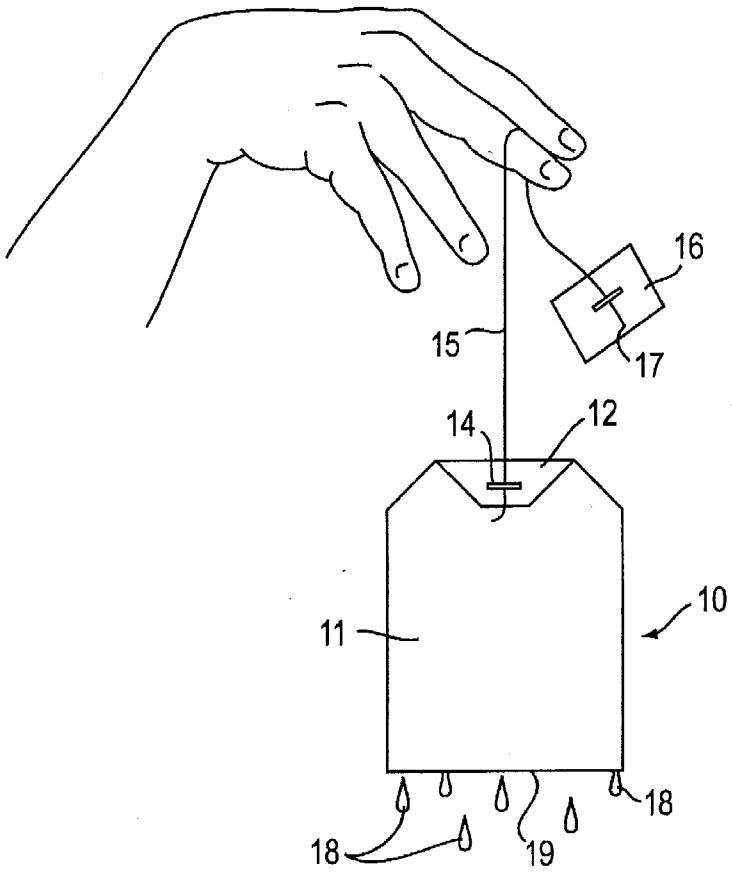
FIG. 1 PRIOR ART
FIG. 1 depicts a profile view of a traditional beverage bag of the kind typically used to brew a single cup of tea.

With reference first to FIG. 1 of the drawing, there is shown a frontal profile view of a beverage bag 10 that is typical of those in common use today. The bag is fabricated of a water-permeable, paper-like material or fabric that is folded to form a generally rectangular envelope 11 which contains a measured quantity of tea, coffee or similar substance. Envelope 11 forming beverage bag 10 may have but a single compartment, or it may be folded at the bottom to provide two generally parallel planar compartments of the same size and shape, or it may take a more complex multi-compartment form as in the "flow-thru" type of beverage bag. For the purposes of this disclosure, beverage bags having a single or multiple compartments will all be referred to as comprising generally planar envelopes. The top of the bag is often folded over diagonally to form a closure flap 12 and the flap is mechanically sealed by means of a staple or other fastener 14. Staple 14 serves as well to attach a handling string 15 to the bag. Frequently a manufacturer's logo tag 16 is attached to the handling string 15 at a point near its free end 17.

After the beverage has been brewed and the bag is ready to be removed, it is lifted from the brewed beverage by the handling string 15 in the manner illustrated in the figure.

Residual liquid remaining in the tea leaves or other bag contents drains down to the bottom of the bag forming droplets 18 that drip off anywhere along the length of the horizontal bottom edge 19. Surface tension, adhesion and cohesion forces tend to inhibit prompt and complete drainage. As a result, liquid continues to drip from the bag for an extended and unpredictable time while the user is waiting to dispose of the bag in an suitable manner.

Figure 2:
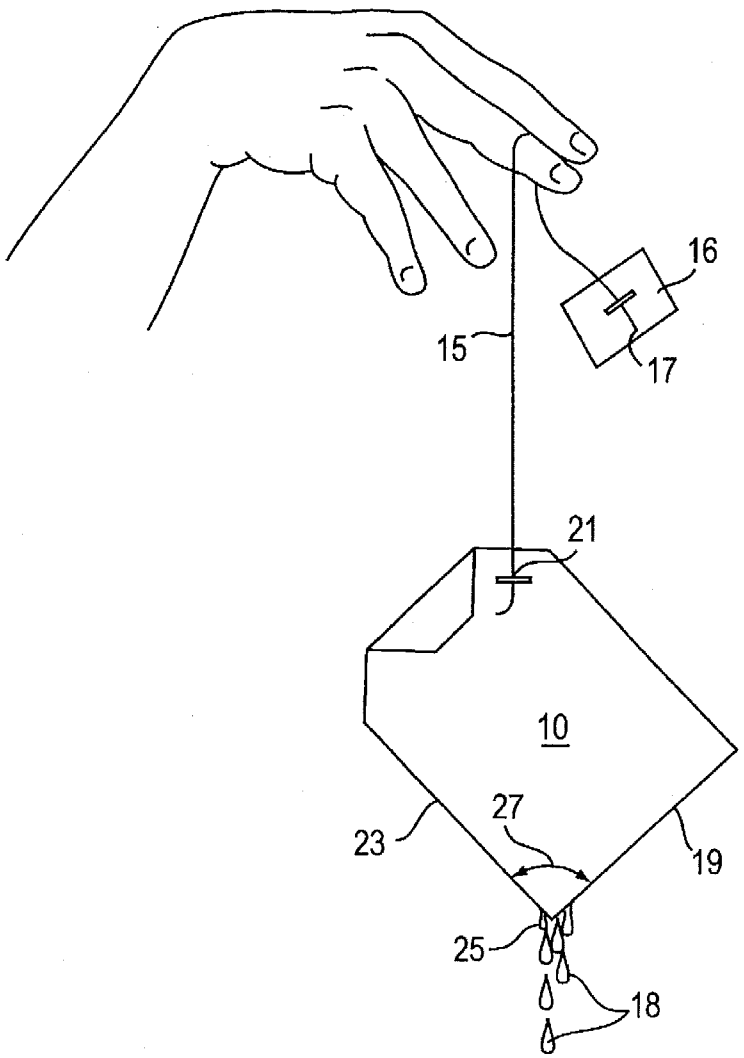
FIG. 2 shows the beverage bag of FIG. 1 having a string handle attached to the bag in accordance with this invention.

The present invention solves the dripping problems associated with prior art beverage bags in a simple and inexpensive way. Referring now to FIG. 2, there is shown a first embodiment of the invention which comprises an improvement to the conventional beverage bag 10 illustrated in frontal profile view in FIG. 1. In this embodiment, handling string 15 is fastened to bag 10 at a location 21 where the wet bag will be caused to hang with its bottom edge 19 and an adjacent side 23 at an angle to the horizontal. In this attitude, the lowest point of the bag is the apex 25 formed by edge 19 and side 23. Since bag 10 is in the shape of a rectangle, the apex angle 27 included between edge 19 and side 23 is 90°. Residual liquid drains to the apex forming droplets 18 that drip from apex 25.

The arrangement of FIG. 2 achieves three desirable effects. First, the average hydraulic head (the average height of the wetted mass above the apex) is increased thereby increasing the rate of liquid drainage and effusion from the bag. Second, the bottom corner drip point at apex 25 concentrates liquid removal because of the cohesive and adhesive forces on the liquid. It also localizes drops 18 which drip from the apex, making it easier to control their destination. Third, the quantity of the saturated wetted mass within bag 10 is considerably smaller because the lowest area of the bag forms the apex of a triangle rather than a rectangle as in the FIG. 1 bag. The relatively smaller amount of liquid remaining in the tea leaves or other bag contents in that triangular area is then reabsorbed by the drained contents of the bag once the bag is returned to the bottom horizontal attitude of the FIG. 1 bag. The net effect is that dripping from the bag totally stops as soon as it is repositioned to the bottom horizontal attitude. These three effects occur whether the beverage bag comprises a simple, single compartment envelope, or is folded double to form two parallel planar compartments, or is of "flow-thru" configuration.

Figure 3B:
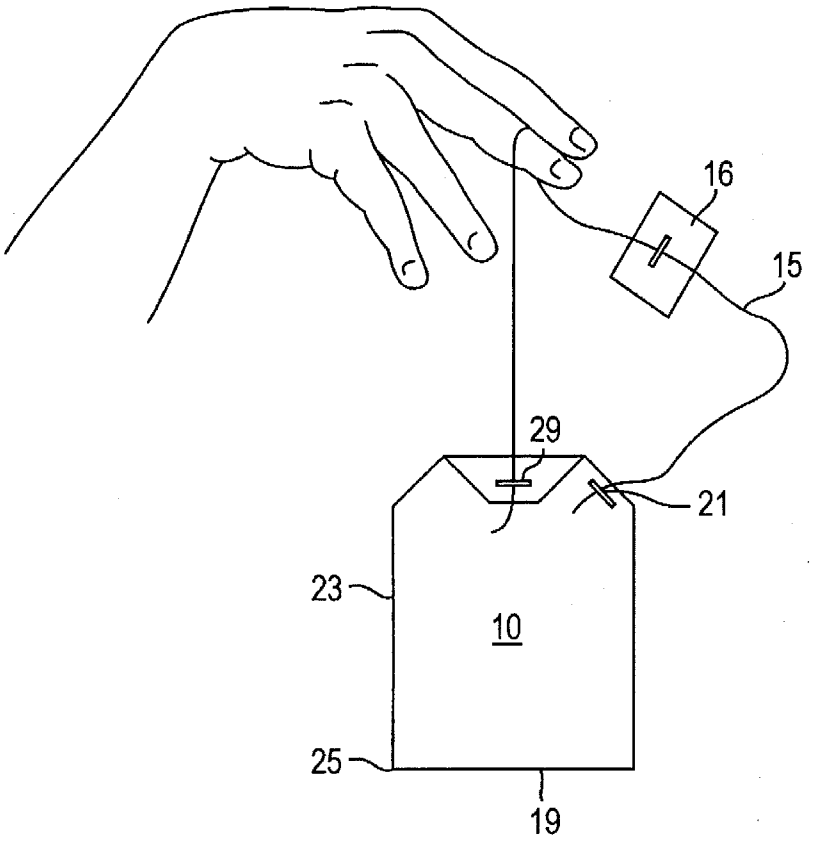
FIG. 3B shows the drained beverage bag of FIG. 3A in the transport position.
Figure 3A:
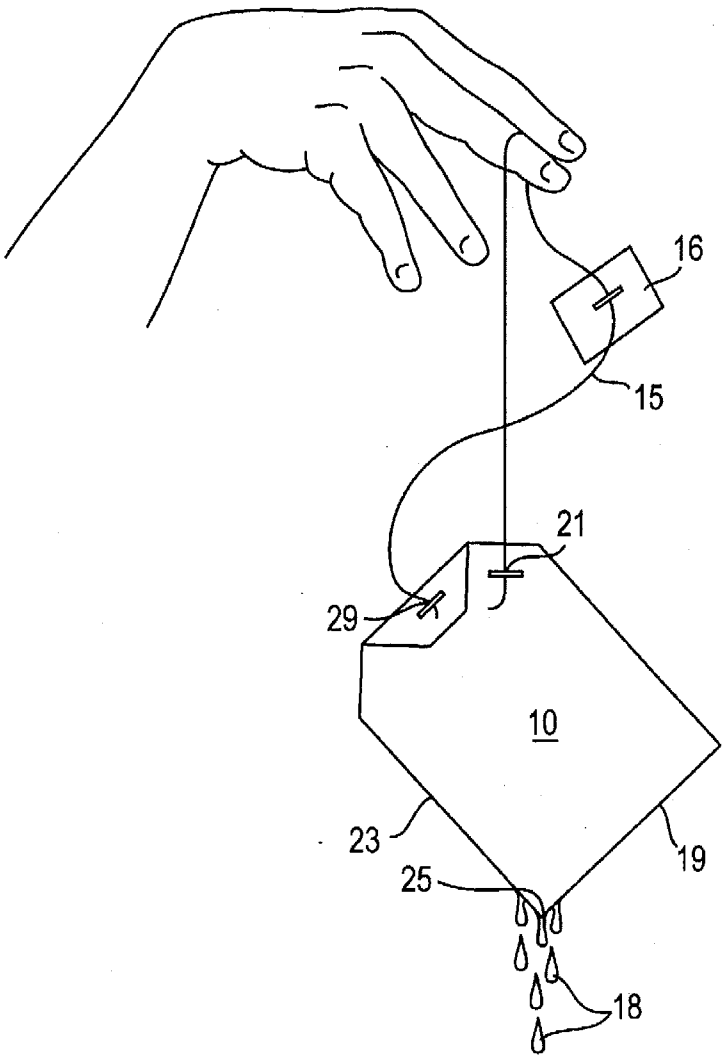
FIG. 3A depicts another embodiment of the FIG. 2 beverage bag in the draining position.

FIGS. 3A and 3B show a preferred embodiment of the beverage bag depicted in FIG. 2. This embodiment allows repositioning of the bag to a bottom horizontal attitude to be accomplished in a simple fashion. One end of handling string 15 is attached to bag 10 at location 21 as is shown in FIG. 2. The other end of string 15, however, is not allowed to be free as in FIG. 2, but instead is attached to the bag at a top center location 29 which may be the same as that location (shown in FIG. 1) at which the string handle is conventionally attached. In use, bag 10 is first lifted out of the brew with that string end which is attached to the bag at point 21, thus causing the bag to hang in the attitude depicted in FIG. 3A with apex 25 at the lowest point. After a short time during which residual liquid rapidly drains from the bag and drips from apex 25, the other end of handling string 15 is made taut and the string end attached to the bag at location 21 is relaxed. The bag is thus returned to a bottom horizontal attitude, illustrated in FIG. 3B, thus causing residual liquid to be redistributed back into the bag contents. Dripping immediately stops. A manufacturer's logo tag 16 may be attached to string handle 15, preferably at a location near the midpoint thereof, to specify the bag contents and to identify the manufacturer. The tag also serves to aid a user in shifting the bag position from its apex-down to its straight side-down orientation.

Figure 4B:
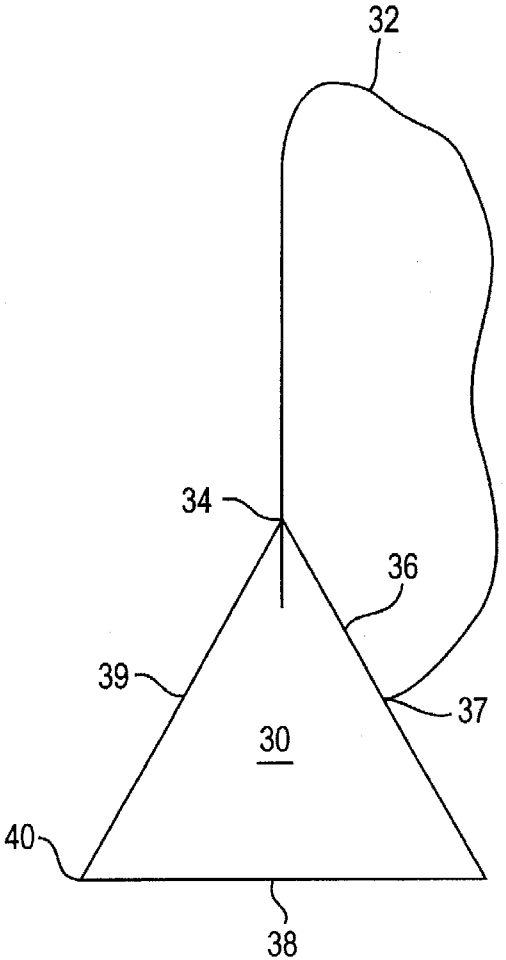
FIG. 4B depicts the beverage bag of FIG. 4A in a transport attitude.
Figure 4A:
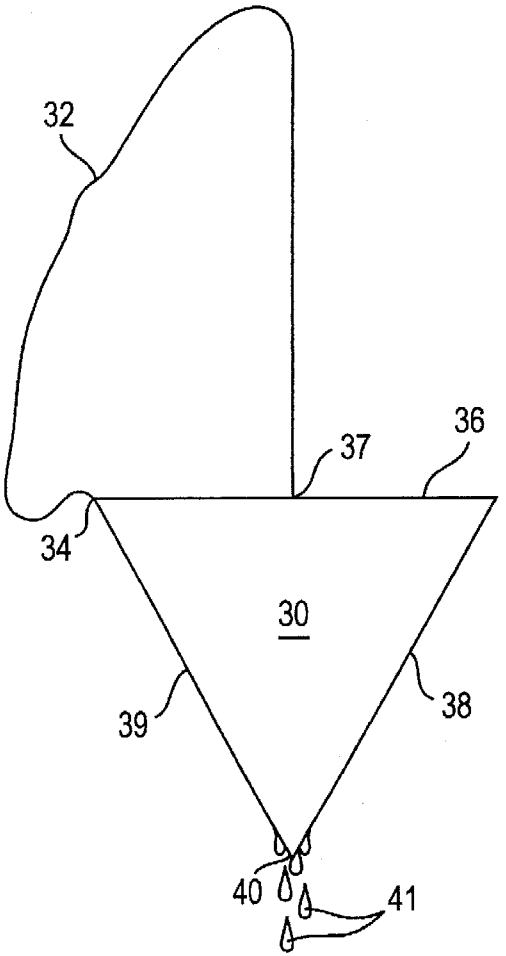
FIG. 4A illustrates another embodiment of the beverage bag in the draining position.

Yet another embodiment of this invention is shown in FIGS. 4A and 4B. In this embodiment, a bag or envelope 30 is fabricated from the same water permeable fabric material used in the manufacture of standard beverage bags, but is shaped in the form of a triangle rather than a rectangle as is conventional. A quantity of tea leaves or other substance from which essences can be extracted by steeping is then sealed within the bag 30. One end of a handling string 32 is attached to an apex 34 of the triangular bag 30 while the other string end is attached to the mid point of a triangle side 36, as for example at location 37 of FIG. 4A. While bag 30 is shown as an equilateral triangle with apex angles of 60°, other triangular shapes can be employed as well. For example, bag 30 can be shaped as an isosceles or scalene triangle.

In use, bag 30 is lifted out of the extract by lifting with that string end which is attached to the bag at the mid point 37 of a side 36, thus causing the bag to hang in the attitude depicted in FIG. 4A with second triangle apex 40 at the lowest point. After a short time during which residual liquid rapidly drains from the bag forming droplets 41 which then drip from apex 40, the end of handling string 32 that is attached to an apex 34 is made taut and the other string end is relaxed. The bag is thus positioned in an attitude wherein triangle side 38, opposite to apex 34, is disposed horizontally in the manner illustrated in FIG. 4B. Residual liquid is then redistributed back into the bag contents, and dripping immediately stops. The used bag can then be neatly moved to a place of disposal.

It is to be noted that the embodiment of FIG. 2, in which a handling string was attached to a beverage bag at a single point, is functional and can find use. However the embodiments depicted in FIGS. 3A and 3B and in FIGS. 4A and 4B are preferred to that of FIG. 2 because these embodiments provide a more complete stop to the dripping of liquid from the used beverage bag and make the transport of a used bag to a disposal receptacle easier. Also, the single handling string that is shown in these embodiments could be replaced with two separate strings.

There is another important advantage to the embodiments of this invention that are illustrated in FIGS. 3 and 4 as well. The handling strings used with conventional beverage bags are made of twisted fibers. The twisted fibers tend to unwind when the bag is suspended by the string, causing the bag to rotate. The tendency of the bag to spin is increased by the fact that the wet bag is heavier and exerts more stress on the string than when it was dry. Such a spinning action makes bag removal and transport to the disposal receptacle more difficult. Because the handling string is secured at both ends in the preferred embodiments of this invention, the annoying tendency of the bag to spin is completely obviated.

While beverage bags of rectangular and triangular shape have been illustrated in the drawings, the beverage bags of this invention are not limited to those particular shapes. In general, a bag of any polygonal shape (including, for example, polygons having five, six, seven or even eight sides) can serve in this invention provided that the following criteria are met. The bag must have at least one substantially straight side that can be disposed in a horizontal attitude. It must also have an apex defined by the intersection of two bag sides, one of which may be the substantially straight side, with an included or apex angle less than 140° and arranged so that the apex will form the lowest bag point when the bag is suspended by a handling string. It is not necessary that the sides of the bag be equal in length nor that they be exactly straight. The substantially straight side could be slightly curved, but any significant degree of curvature will increase the tendency of the used bag to drip when it is oriented in a horizontal attitude.

Figure 5:
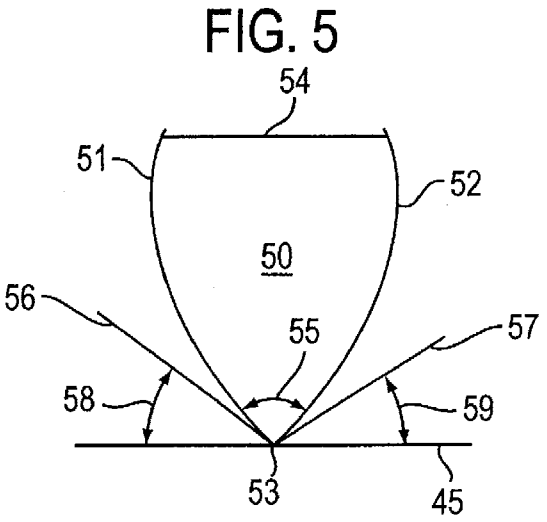
FIG. 5 illustrates a beverage bag of this invention in which one or more of the bag sides is a convex curve.
Figure 6:
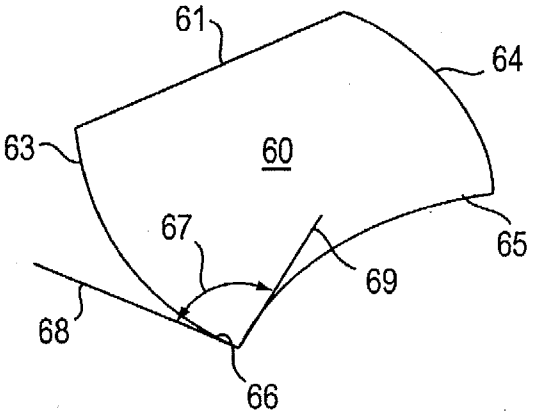
FIG. 6 illustrates another embodiment in which at least one of the bag sides is a concave curve.

As was stated before, it is not necessary that all of sides of the bag be straight. In some instances, curved bag sides can actually increase the speed at which a wet bag drains. Referring now to FIGS. 5 and 6, there are shown embodiments of this invention which employ curved sides to the beverage bag. The beverage bag 50 of FIG. 5 is fabricated from the same water permeable fabric material used in the manufacture of standard beverage bags, as is bag 60 of FIG. 6. Bag 50 has two sides, 51 and 52, that curve concavely outwardly intersecting at apex 53, and one straight side 54. The bag is depicted in its drain attitude with apex 53 being the lowest point. With curved sides bounding the apex, the apex angle bounded by those sides is defined as the angle 55 measured between tangents 56 and 57 to the arcuate sides 51 and 52 respectively at their intersection point 53. In this embodiment, and in all other embodiments of this invention, it is important that the apex angle 55 be less than about 140° and that the smaller of angles 58 and 59 (measured between tangents 56 and 57 and horizontal plane 45, respectively), be at least 20°. Drainage of residual liquid from the used beverage bag is adversely affected if the apex angle exceeds about 140° or if the angle formed between the bag sides and a horizontal plane is below about 20°. It is preferred in all embodiments of this invention that the length of the substantially straight side be at least one-eighth the bag perimeter, that the apex angle be less than 120°, and that the smaller of the angles formed between the bag sides and a horizontal plane (when the bag is suspended in a draining attitude) be at least 30°.

Turning now to FIG. 6, there is depicted another embodiment of this invention in which bag 60 is shown in its draining position. It is formed with one substantially straight side 61, two sides 63 and 64 that curve concavely outwardly, and a fourth side 65 having a convex curvature. Concave side 63 and convex side 65 intersect at apex point 66 to define an apex angle 67 that is measured between tangents 68 and 69 to the arcuate sides 63 and 65 respectively at their intersection point 66. Although not shown on either FIGS. 5 or 6, a handling string is attached to each bag in the manner described in relation to FIGS. 2, 3 and 4 so that the apex is the lowest point of the bag when it is suspended in the draining position, and the substantially straight side is disposed in a generally horizontal plane when the bag is in the transport position.

As may now be appreciated, this invention solves in a simple and unique fashion the long standing and annoying problem caused by dripping of residual liquid from used beverage bags as they are removed from the extract for disposal. It is to be understood that the beverage bags that are described in the specification and illustrated in the drawings represent those presently preferred embodiments of the invention. Various other modifications and additions may be made to the disclosed embodiments without departing from the spirit and scope of the invention.

The embodiments of the invention in which exclusive rights are asserted are set out in the following claims.

I claim:

1. A method for preventing dripping of steeping liquid from a water-permeable beverage bag during its transport from the steeping liquid to a place of disposal comprising:

forming the beverage bag as a generally planar envelope having a plurality of sides around its perimeter and containing a substance from which essences are extracted, at least one of said sides being substantially straight, said envelope having an apex formed by the intersection of two of said envelope sides, the apex angle included between said two envelope sides being less than 140°;

steeping said bag and its contained substance in a hot liquid;

removing said bag from the steeping liquid and suspending said bag from first handle means attached to the bag at a location such that said bag is oriented so that said apex is caused to be the lowermost bag point;

allowing steeping liquid to drip from said apex;

then reorienting said bag so that its substantially straight side is positioned in a generally horizontal plane and is then the lowermost part of the bag by suspending said bag from a second handle means that is attached to said bag at a second location; and then transporting the bag to another place for disposal.

2. The method of claim 1 wherein said apex angle is less than 120° and the length of said substantially straight envelope side is at least one-eighth the envelope perimeter.

3. The method of claim 1 including attaching second handle means to the bag in a manner that causes the bag to be oriented with its substantially straight side in a generally horizontal plane when the bag is suspended by said second handle means.

4. The method of claim 3 including fashioning said first and second handle means from a single length of string.

5. The method of claim 3 wherein the envelope is formed in the shape of a rectangle having around its perimeter, a top, bottom, and two sides, and wherein said first and second handle means comprise a single length of string, one end of said string forming the first handle means and attached to said envelope in the region of the bag where the top and an upper portion of one of said sides meets, the other string end forming said second handle means and attached to the envelope at the center of said envelope top.

6. The method of claim 5 including providing a tag attached to said string near the midpoint thereof, said tag carrying indicia specifying the substance contained in the envelope and identifying the manufacturer thereof.

7. The method of claim 6 wherein said substance is tea.

8. The method of claim 6 wherein said substance is coffee.

9. The method of claim 3 wherein the envelope is formed in the shape of a triangle and wherein said first and second handle means comprise a single length of string, one string end forming said first handle means and attached to the envelope at the midpoint of a first triangle side, the other string end forming said second handle means and attached to the envelope at an apex formed by the intersection of any two of the triangle sides.

10. A beverage bag consisting of a generally rectangular planar envelope fabricated of a water-permeable material, said envelope containing a substance from which essences can be extracted by steeping in a liquid, said envelope having around its perimeter, a top, a bottom, and two sides, and a handle means attached thereto, said handle means having two ends, a first handle end fixedly attached to said envelope at the approximate middle of said envelope top, and a second handle end fixedly attached to said envelope in the region of the bag where the top and an upper portion of one of said sides meet, such that upon removal of said beverage bag from a steeping liquid, said bag can be hung with an apex between a side and the bottom of the bag being the lowermost point of the bag by suspending the bag from the second handle end and such that said bag can be reoriented and hung with said bottom being the lowermost point of the bag by suspending the bag from the first handle end.

11. The beverage bag of claim 10 wherein said substance from which essences can be extracted is tea.

12. The beverage bag of claim 10 wherein said handle means comprises a string that is made of twisted fibers.

13. The beverage bag of claim 10 wherein said handle means has a tag attached near the midpoint thereof.

14. A beverage bag comprising a generally triangular planar envelope fabricated of a water-permeable material and containing a substance from which essences can be extracted by steeping in a liquid, said envelope having around its perimeter three sides and a handle means attached thereto, said handle means having two ends, a first handle end fixedly attached to the envelope at the approximate midpoint of a first envelope side, and a second handle end fixedly attached to the envelope near an apex formed by the intersection of any two of the envelope sides such that upon removal of said beverage bag from a steeping liquid, said bag can be hung with an apex being the lowermost point of the bag by suspending the bag from the first handle end and such that said bag can be reoriented and hung with one of its sides being the lowermost part of the bag by suspending the bag from the second handle end.

15. The beverage bag of claim 14 wherein said substance from which essences can be extracted is tea.

16. The beverage bag of claim 14 wherein said handle means comprises a string that is made of twisted fibers.

17. The beverage bag of claim 14 wherein said handle means has a tag attached near the midpoint thereof.

* * * * *